US011008991B2

(12) United States Patent
Stucchi et al.

(10) Patent No.: US 11,008,991 B2
(45) Date of Patent: May 18, 2021

(54) FUEL ELECTRO-INJECTOR ATOMIZER, IN PARTICULAR FOR A DIESEL CYCLE ENGINE

(71) Applicant: C.R.F. SOCIETÀ CONSORTILE PER AZIONI, Orbassano (IT)

(72) Inventors: Sergio Stucchi, Orbassano (IT); Raffaele Ricco, Orbassano (IT); Onofrio De Michele, Orbassano (IT); Marcello Gargano, Orbassano (IT); Carlo Mazzarella, Orbassano (IT); Domenico Lepore, Orbassano (IT)

(73) Assignee: C.R.F. SOCIETÀ CONSORTILE PER AZIONI, Orbassano (IT)

( * ) Notice: Subject to any disclaimer, the term of this patent is extended or adjusted under 35 U.S.C. 154(b) by 36 days.

(21) Appl. No.: 15/711,671

(22) Filed: Sep. 21, 2017

(65) Prior Publication Data

US 2018/0080423 A1 Mar. 22, 2018

(30) Foreign Application Priority Data

Sep. 22, 2016 (EP) ..... 16425092

(51) Int. Cl.
*F02M 61/18* (2006.01)
*F02M 61/12* (2006.01)
(Continued)

(52) U.S. Cl.
CPC ..... *F02M 61/1846* (2013.01); *F02M 61/06* (2013.01); *F02M 61/08* (2013.01); *F02M 61/12* (2013.01); *F02M 61/10* (2013.01)

(58) Field of Classification Search
CPC .... F02M 61/1846; F02M 61/06; F02M 61/08; F02M 61/10; F02M 61/12;
(Continued)

(56) References Cited

U.S. PATENT DOCUMENTS 2,263,197 A 11/1941 Tabb et al.
4,867,128 A * 9/1989 Ragg ..... F02M 51/08 123/531
(Continued)

FOREIGN PATENT DOCUMENTS

EP 0879953 11/1998
EP 1559904 8/2005
(Continued)

OTHER PUBLICATIONS

European Patent Office Search Report dated Mar. 9, 2017, for European Patent Application No. 16425092.0, Applicant, C.R.F. Società Consortile Per Azioni (7 pages).

*Primary Examiner* — Qingzhang Zhou
*Assistant Examiner* — Christopher R Dandridge
(74) *Attorney, Agent, or Firm* — McCracken & Gillen LLC

(57) ABSTRACT

An atomizer of a fuel electro-injector is equipped with a nozzle and a valve needle having a head, which is coupled to a sealing seat of the nozzle, and stem, which engages an inner seat of the nozzle; the stem and the nozzle define an annular passageway with a chamber that axially terminates at the sealing seat; the stem has an intermediate portion coupled in an axially sliding manner in the inner seat and defining a plurality of channels, the outlets of which are arranged on the annular chamber; the sealing seat and the head of the valve needle define a discharge section, which is annular and has a width that increases as the opening stroke of the valve needle proceeds; the ratio between the depth and the outer chord of the minimum cross-section of the channels is greater than or equal to two.

11 Claims, 6 Drawing Sheets

(51) Int. Cl.
*F02M 61/08* (2006.01)
*F02M 61/06* (2006.01)
*F02M 61/10* (2006.01)

(58) Field of Classification Search
CPC ..... F02M 61/1833; F02M 61/1806; F02M 61/1886; F02M 61/163; F02M 61/042; F02M 61/1873; F02M 61/1893
See application file for complete search history.

(56) References Cited

U.S. PATENT DOCUMENTS 5,829,688 A * 11/1998 Rembold ..... B23H 9/00
239/585.1
8,668,156 B2 * 3/2014 Lee ..... F02M 61/1893
239/453

FOREIGN PATENT DOCUMENTS

| | | | | |
|---|---|---|---|---|
| EP | 1734250 | | 12/2006 | |
| EP | 3018340 | | 5/2016 | |
| EP | 3165759 | | 5/2017 | |
| IT | 3018340 | * | 11/2016 | ..... F02M 61/08 |

* cited by examiner

FUEL ELECTRO-INJECTOR ATOMIZER, IN PARTICULAR FOR A DIESEL CYCLE ENGINE

PRIORITY CLAIM

The present application claims priority from European Patent Application No. 16425092.0 filed on Sep. 22, 2016, which is owned by the assignee of the present application, and the disclosure of which is incorporated herein in its entirety by reference.

TECHNICAL FIELD OF INVENTION

The present invention relates to an atomizer of a fuel electro-injector for injecting fuel into the combustion chamber of an internal combustion engine. Preferably, but not exclusively, the present invention refers to a fuel injection system of the common rail type for a diesel cycle engine.

STATE OF THE ART

In internal combustion engines, the fuel injectors are equipped with an atomizer having a nozzle and a needle, which moves under the action of an actuator for opening and closing a sealing seat provided on the nozzle.

In particular, in the more common diesel cycle engines, the needle is operated by means of a servo-actuation system, and therefore indirectly, basically because of the high operating forces required to move the needle, even if there is increasing awareness of the need to design injectors with direct actuation of the needle, in particular to enable more complex laws of actuation (for example, the so-called "boot shaped" ones).

In general, the atomizer is designed with the objective of obtaining a fuel spray such as to achieve a fuel-air distribution as homogenous as possible in the combustion chamber of the respective cylinder of the engine. In particular, good homogenization ensures fuel efficiency and therefore reduces pollutant emissions.

In some solutions currently in production and characterized by a "solid cone" fuel spray, the nozzle of the atomizer has a series on injection holes, of predetermined size (for example, injection holes with a diameter of 0.12 mm each), arranged in equidistant positions around the axis of the injector. The needle moves axially under the control of the electro-actuator so as to open/close a sealing seat provided in an annular passageway upstream of these injection holes. Normally, the electro-actuator is defined by a solenoid actuator.

In multi-hole atomizer solutions of this type, the lift of the needle causes a discrete change in fuel flow, basically of the on-off type. Therefore, the quantity of fuel injected on each injection is determined by opening times of the nozzle and by the fuel supply pressure, but not by the lift of the needle.

The sole exception is represented by pilot injections, where fuel volumes below 3-4 $mm^3$ are introduced: in fact, in this case, the needle actuation times are extremely small and do not allow the needle to lift completely: in any case, the volume of fuel introduced still depends on the actuation time of the electro-actuator.

In a completely different type of injector, the atomizer has a needle of the so-called pintle type, i.e. an outwardly opening nozzle type, by pushing the needle via a piezoelectric or magnetostrictive actuator.

Solutions of this type are described, for example, in EP1559904.

In this type of solution, the electric control signal supplied to the actuator causes a lengthening of the actuator, proportional to the supplied electric control signal, and this lengthening, in turn, causes translation of the needle in a direction concordant with the aforesaid lengthening. When no electric control signal is present, the actuator automatically shortens and returns to its initial length: a spring then provides for returning the needle to the closed position. The tip of the needle is generally defined by a head delimited by a truncated-cone surface that comes into abutment against a sealing seat defined by a circular ring on the nozzle when the latter is closed.

The spray resulting from this type of atomizer has a conical or umbrella-like shape, commonly known as a "hollow cone", as it extends uniformly around the entire circumference of the sealing seat on the nozzle.

It is evident that the axial position of the needle, and therefore the circular section of the fuel discharge, vary continuously and not discretely, according to the electric control signal supplied to the actuator. In other words, in this case, the amount of fuel injected on each injection is also determined by the variable lift of the needle.

Apart from this advantage, this type of solution has less fuel leakage and does not contemplate any fuel well, which multi-hole atomizers instead have between the sealing seat and the injection holes.

However, atomizers opening by means of outwards movement of the needle have a significant drawback.

In fact, to have optimal combustion, with high efficiency and minimum emissions (especially minimal amounts of particulate), for a diesel cycle engine it is necessary that:

- the field of motion of the fuel spray has a high velocity, so as to achieve optimal mixing with the combustion air;
- the distribution of fuel in the combustion chamber is as homogeneous as possible; and
- the fuel spray has high penetration, to avoid fuel stopping close to the centre axis of the combustion chamber: in fact, air speed and turbulence are lowest, right in this area, and so the mixture would be fuel-rich (with consequent production of unburnt hydrocarbons and carbonaceous particulate).

In the case of a hollow-cone spray, the spray pattern is homogeneous over 360° and has relatively limited penetration. Therefore, the hollow-cone spray is not suitable for achieving optimal combustion. Thus, from the standpoint of fuel penetration in the combustion chamber, a solid-cone spray of the multi-hole atomizer is preferable.

The solutions proposed in FIG. 9 of U.S. Pat. No. 5,829,688 and in European Patent Application 15193750.5 of 9 Nov. 2015 enable achieving a fuel spray pattern of a hybrid and/or non-homogeneous type. In these solutions, the needle of the atomizer is constituted by a head and a stem equipped with a shaped intermediate portion, which is coupled in an axially sliding manner to a cylindrical inner surface of the nozzle. Between them, this cylindrical inner surface and the shaped intermediate portion of the stem define a plurality of axial passages or channels, the outlets of which are relatively close the sealing seat provided for closing the fuel outlet from the nozzle.

Through opportune simulations, it has been noted that it is possible to achieve a fuel spray pattern that is constituted by a central part with an umbrella shape, continuous for 360° around the head of the needle, and by a plurality of cusps or tentacles, which protrude from the central part and are equal in number to the above-described axial passages.

The teachings and structural characteristics set forth in U.S. Pat. No. 5,829,688 and in European Patent Application 15193750.5 do not provide any indication on the optimal configuration for the shape of the cross-section and/or the number of axial passages. In particular, the teachings of U.S. Pat. No. 5,829,688 are aimed at defining the shape of the cross-section and the number of axial passages so as to make the shape of the injected fuel spray smooth.

Therefore, these solutions of the known art are aimed at always obtaining a fuel spray with an umbrella-shaped central part of significant breadth. However, even if it is possible to achieve a spray pattern that is not homogeneous, the central part of this spray has a negative effect on combustion, especially in certain engine operating conditions, as it entails lower fuel penetration in the combustion chamber.

Thus, there is the need to optimize the shape of the cross-section and/or the number of axial passages inside the atomizer to reduce as far as possible the size of the central umbrella-shaped part of the fuel spray and, consequently, get as close as possible to a fuel spray pattern like the one produced by a multi-hole atomizer.

OBJECT AND SUMMARY OF THE INVENTION

The object of the present invention is that of providing an atomizer for a fuel electro-injector that enables the above-described need to be met in a simple and inexpensive manner. According to the present invention, an atomizer for a fuel electro-injector is provided as defined in claim 1.

BRIEF DESCRIPTION OF DRAWINGS

For a better understanding of the present invention some preferred embodiments will now be described, purely by way of a non-limitative example, with reference to the accompanying drawings, where.

DETAILED DESCRIPTION OF THE INVENTION

The present invention will now be described in detail with reference to the accompanying drawings to enable an expert in the field to embody it and use it.

Figure 1:
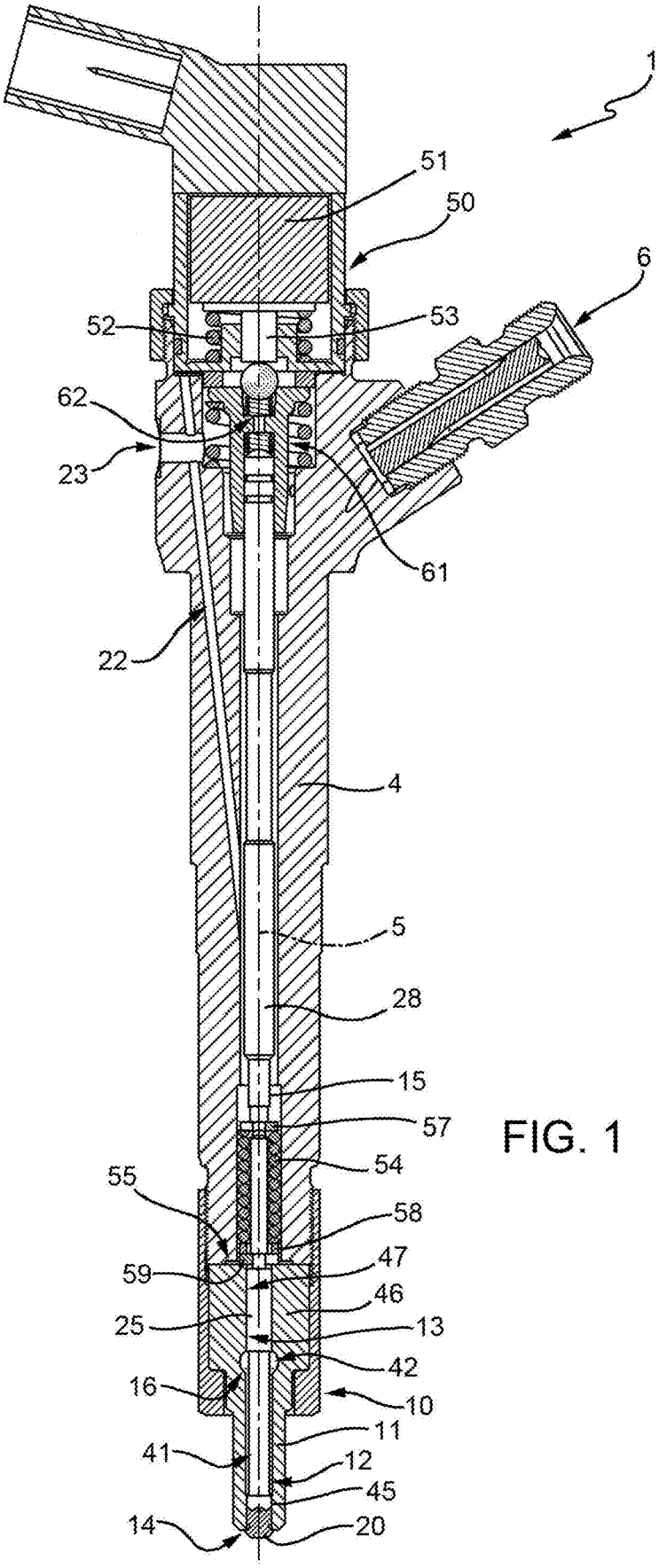
FIG. 1 shows, in section along a meridian section, a first preferred embodiment of the atomizer of a fuel electro-injector according to the present invention.

In FIG. 1, reference numeral 1 indicates a fuel electro-injector (shown in a simplified manner) forming part of a high-pressure fuel injection system, for injecting fuel into a combustion chamber 2 (schematically shown in FIG. 3) of an internal combustion engine. In particular, the injection system is of the common rail type, for a diesel-cycle internal combustion engine.

The electro-injector 1 comprises an injector body 4, which extends along a longitudinal axis 5, is preferably formed by a number of pieces fastened together, and has an inlet 6 to receive fuel supplied at high pressure, in particular at a pressure in the range between 600 and 2800 bar. In particular, the inlet 6 is connected, in a manner not shown, to a common rail, which in turn is connected to a high-pressure pump (not shown), also forming part of the injection system.

The electro-injector 1 ends with a fuel atomizer 10 comprising a nozzle 11, which is fastened to the injector body 4 and has a feedthrough seat 13 along axis 5. The atomizer 10 also comprises a valve needle 12, which extends along axis 5 and is axially movable in the seat 13 for opening/closing the nozzle 11, by performing an opening stroke, or lift, directed axially outwards from the seat 13, and a closing stroke directed axially towards the inside of the nozzle 11 and the injector body 4.

Given this movement configuration, this type of electro-injector 1 is generally referred to as an "outwardly opening nozzle type", or a "hollow cone spray".

In the example shown in FIG. 1, the valve needle 12 has a rear end portion 15 resting axially against a drive rod 28, defined by a separate piece arranged in an intermediate zone of the injector body 4. According to an alternative that is not shown, the valve needle 12 and the rod 28 form a single piece.

Figure 2:
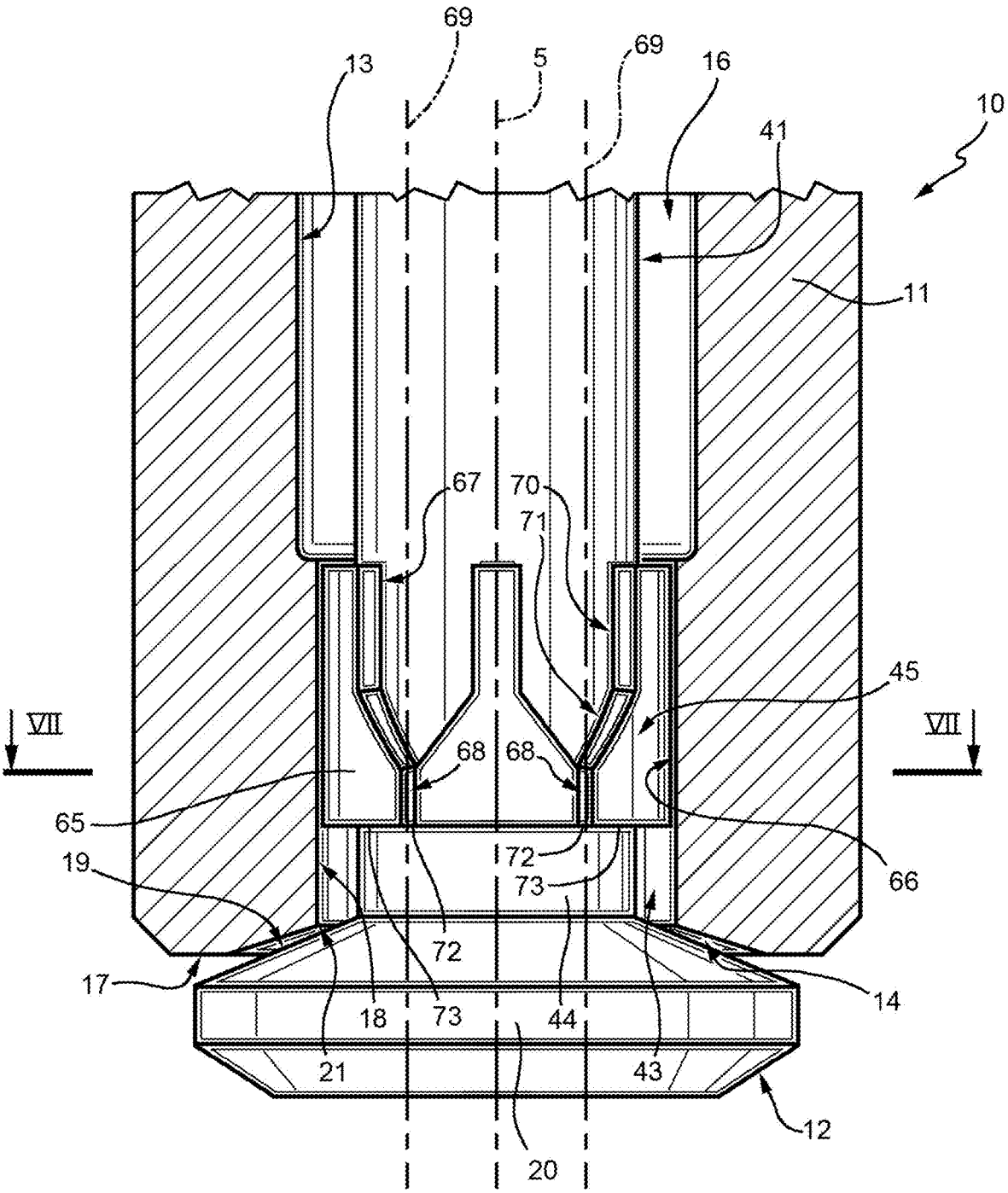
FIG. 2 is an enlargement of a tip of the atomizer in FIG. 1, with a nozzle shown in section and a valve needle shown with parts on view.

Referring to FIG. 2, the nozzle 11 has a sealing seat 21, which, together with a head 20 of the valve needle 12, defines a discharge section 14 for the fuel. The discharge section 14 has a continuous, circular, ring-like shape, with a width that is constant along the circumference, but which continuously increases as the opening stroke of the valve needle 12 proceeds.

Figure 5:
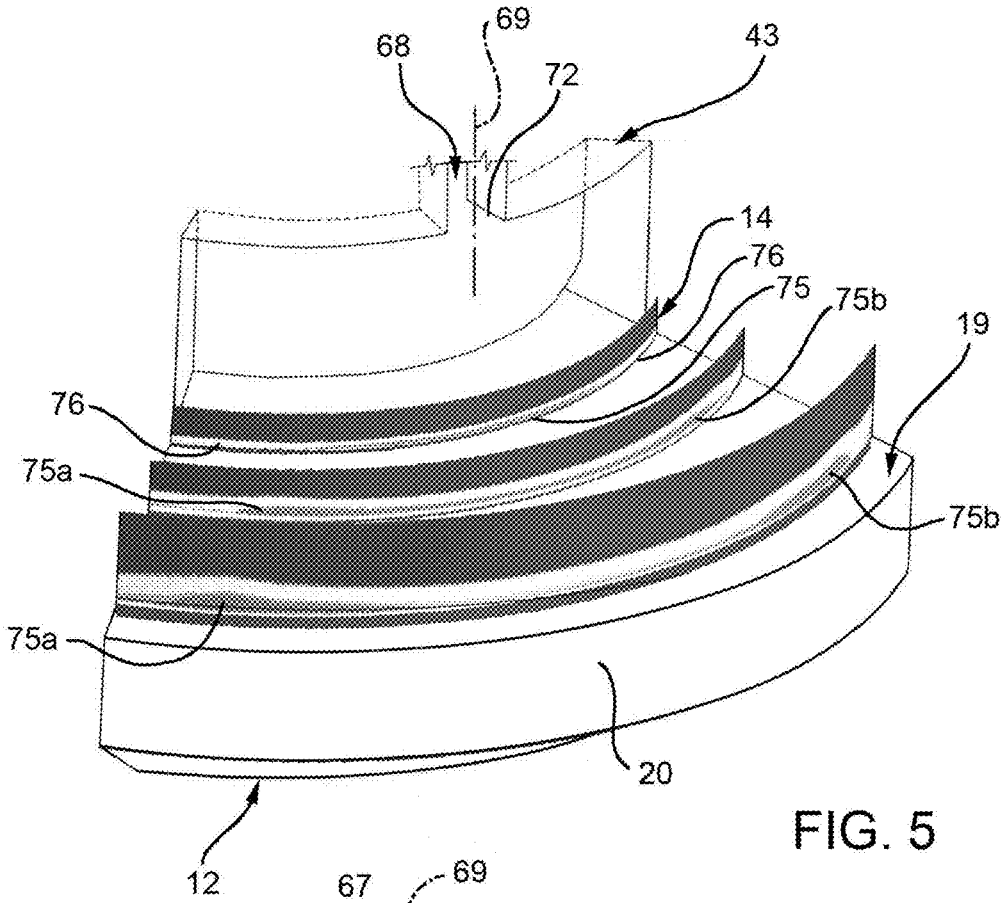
FIG. 5 is a different perspective that shows diagrams regarding fuel velocity in the spray delivered by the atomizer according to the injection method of the present invention, for three different positions.

The fuel is thus injected into the combustion chamber 2 with a spray that is continuous along the circumference of the discharge section 14, i.e. with a spray that, immediately downstream of the discharge section 14, is conical or umbrella-shaped, as can also be seen in FIG. 5. The flow of fuel injected through the discharge section 14 is variable, proportional to the axial travel of the valve needle 12.

Even if not clearly visible in FIG. 2, the sealing seat 21 is not defined by a sharp-edged surface, but by a circular ring with a chamfered or radiused surface, which connects together a front surface 17, external to the seat 13 and to the sealing seat 21, and a cylindrical surface 18 of the seat 13. The chamfered or radiused surface of the sealing seat 21 reduces the pressure or specific load of the head 20 on the nozzle 11 during closure and therefore reduces stress and risks of fatigue failure.

The head 20 has an external diameter larger than the maximum diameter of the sealing seat 21 and of the remaining part of the valve needle 12. Near the nozzle 11, the head 20 is delimited by a surface 19 suitable for shutting against the sealing seat 21 and defined by a truncated cone or a convex segment of a sphere symmetrical with respect to axis 5. These two components, when mated in contact, define a single "static seal", i.e. a seal that guarantees perfect closure of the outlet of the nozzle 11.

As mentioned above, the sealing seat 21 and the valve needle 12 are sized so as to define a discharge section 14 that varies continuously, and not in a step-wise discrete manner, as the axial position of the valve needle 12 varies. In particular, when starting from the closed position, in which surface 19 of the head 20 rests against the sealing seat 21 and the nozzle 11 is therefore closed, the outward opening stroke of the valve needle 12 causes an initial opening of the nozzle 11 and then a progressive increase in the discharge section 14 for the fuel.

With a relatively small opening stroke, the discharge section 14 is also relatively small, and so the fuel is injected with high atomization and a spray characterized by lower penetration.

With a relatively large opening stroke, the discharge section 14 is also relatively large.

As will be better described hereinafter, the fuel is injected with a spray characterized by high penetration.

With reference to FIG. 1, the atomizer 10 has an annular passageway 16, which is radially defined by a stem 41 of the valve needle 12 and by the seat 13 of the nozzle 11. The annular passageway 16 comprises an end zone 42 that permanently communicates with the inlet 6 through at least one passage (not shown), made in the injector body 4 and in the nozzle 11, thereby defining a high-pressure environment. More specifically, the end zone 42 is defined by an annular chamber, generally known as a "cardioid" and having a wider cross-section than the remaining part of the annular passageway 16.

At the end zone 42 of the annular passageway 16 there is substantially the same supply pressure (prail) provided by the fuel injection system. The injector body 4 also has a low-pressure environment 22, which communicates with an outlet 23 connected, in use, to lines (not shown) that return fuel to a fuel tank and which are at a low pressure, for example, around 2 bar.

As can be seen in FIG. 2, at the opposite axial end, the annular passageway 16 comprises an annular chamber 43, which is radially delimited by surface 18 and by an axial end 44 of the stem 41. The axial ends of the annular chamber 43 are defined by surface 19 of the head 20 and by an intermediate portion 45 of the stem 41, which will be described in detail hereinafter. In other words, the annular chamber 43 axially ends at the sealing seat 21, so that the fuel can be injected into the combustion chamber 2 through the discharge section 14.

As can be seen in FIG. 1, at the opposite axial end with respect to the sealing seat 21, the nozzle 11 comprises a rear guide portion 46 having a guide hole 47, defined by an area of the seat 13 and engaged in an axially sliding manner by a slider portion 25 of the valve needle 12.

The coupling zone between portion 25 and the guide hole 47 defines a so-called "dynamic seal". In general, a "dynamic seal" means a sealing zone defined by a shaft/hole type of coupling, with sliding and/or a guide between the two components, where play in the radial direction is sufficiently small to render the amount of fuel that seeps through to be negligible. In particular, this radial coupling play is less than or equal to 2 microns. Also thanks the small size of this radial play, a relatively small amount of fuel leaks from the end zone 42 of the annular passageway 16: this fuel will then flow to the outlet 23 to return to the fuel tank. Preferably, the above-mentioned "dynamic seal" axially separates the annular passageway 16 directly from the low-pressure environment 22.

Preferably, the diameter of surface 18 at the chamber 43 is equal to that of the guide hole 47, while in the other zones of the annular passageway 16 the internal diameter of the seat 13 is greater than or equal to this value. At the same time, the average diameter of the sealing seat 21 is slightly larger than the diameter of the guide hole 47 and of surface 18. Therefore, the difference between the diameter of the dynamic seal at the guide hole 47 and the average diameter of the static seal at the sealing seat 21 causes an imbalance in the axial forces exerted by the fuel pressure on the valve needle 12 when the nozzle 11 is closed by the head 20 of the valve needle 12: in any case, this is a controlled imbalance predetermined by design, which must not exceed the force exerted by the spring 54 (described hereinafter). Alternatively, it is possible to replace the chamfer on the sealing seat 21 with a sharp-edged surface, where permitted by the operating pressures, or if it is possible to assume using a very hard material (for example, tungsten carbide) for the nozzle 11, or even possibly resorting to surface hardening treatments, such as DLC (carbon like diamond) or nitriding: in this case, the diameter of the dynamic seal becomes exactly equal to the diameter of the sealing seat 21.

According to variants that are not shown, the relation between the average diameter of the sealing seat 21 and the diameter of the guide hole 47 is different from that indicated above for the preferred embodiments discussed and illustrated herein.

To cause translation of the valve needle 12, the electro-injector 1 comprises an actuator device 50, in turn comprising an electrically-controlled actuator 51, i.e. an actuator controlled by an electronic control unit (not shown) that is programmed, for each step of injecting fuel and the associated combustion cycle in the combustion chamber 2, to supply the actuator 51 with one or more electric control signals to perform corresponding injections of fuel.

The type of actuator 51 is such as to define an axial displacement proportional to the electric control signal received: for example, the actuator 51 could be defined by a piezoelectro-actuator or by a magnetostrictive actuator. The actuator device 50 further comprises a spring 52, which is preloaded to exert axial compression on the actuator 51 to increase efficiency.

The excitation given by the electric control signal causes a corresponding axial extension of the actuator 51 and consequently a corresponding axial translation of a piston 53, which is coaxial and fixed with respect to an axial end of the actuator 51. In the particular example shown FIG. 1, the same spring 52 holds the piston 53 in a fixed position with respect to the actuator 51.

The axial translation of the piston 53 pushes on the valve needle 12, via the rod 28, and consequently causes the opening of the nozzle 11, against the action of a spring 54, which is preloaded to axially push the valve needle 12 inwards and consequently to close the nozzle 11.

In particular, the spring 54 is arranged axially between an axial end shoulder of the nozzle 11, indicated by reference numeral 55, and the end portion 15 of the valve needle 12.

Preferably, the spring 54 rests axially, on one side, against a half-ring 57 that, in turn, axially abuts against the end portion 15 and, on the other side, against a spacer 58, which in turn axially abuts against a half-ring 59 resting on the shoulder 55. Alternatively, the spacer 58 could be arranged between the spring 54 and the half-ring 57. The axial thickness of the spacer 58 can be opportunely chosen to adjust the preloading of the spring 54. The half-ring 57 is simply slipped on the valve needle 12, or is fastened to the valve needle 12, for example by welding or interference fitting. According to a variant that is not shown, the half-ring 59 is not present, while the spacer 58 rests directly on the shoulder 55.

Preferably, the spring 54 is arranged in a cavity forming part of the low-pressure environment 22. Furthermore, the spring 54 advantageously has a preloading of between 60 and 150 N so as to exert sufficient closing force to overcome the above-stated imbalance and immediately return the valve needle 12 to the closed position once the action of the actuator 51 ceases. In particular, the preload value of the spring 54 must be chosen in the design phase in a manner proportional to the static seal diameter, i.e. the average diameter of the sealing seat 21, and in a manner proportional to the maximum value of the fuel supply pressure.

Preferably, but not exclusively, the actuator 51 is coupled to the valve needle 12 by a hydraulic linkage 61. The hydraulic linkage 61 comprises a pressure chamber 62, which is coaxial with the valve needle 12 and the piston 53, and defines a control volume filled with fuel that, once compressed, transmits axial thrust from the piston 53 to the valve needle 12. The amount of fuel in the control volume of the pressure chamber 62 varies automatically to compensate the axial play and dimensional variations of the valve needle 12 and the rod 28 during operation, in a manner not described in detail.

According to variants that are not shown, the hydraulic linkage 61 is sealed with respect to the external hydraulic circuit of the fuel and is filled with a fluid free of dissolved air (which would increase compressibility) and/or with a bulk modulus larger than that of the fuel.

As can be seen in FIG. 2, the intermediate portion 45 is axially set apart from portion 25 and is constituted by a plurality of sectors 65, which protrude radially outwards so as to couple in an axially sliding manner with a surface 66 of the seat 13. The sectors 65 are separated from each other in the circumferential direction by passages 67, which allow the passage of fuel towards the annular chamber 43. In general, the number of passages 67 is greater than or equal to three and they are evenly distanced from each other around axis 5. The passages are made on the outer surface of portion 45, and so are outwardly radially delimited by surface 66.

The passages 67 can be made in the stem 41 by material removal, for example by micro-milling, electron discharge or laser machining. If necessary, the passages 67 and sectors 65, or rather portion 45, can be defined by a bushing that defines a piece separate from the rest of the valve needle 12 and is fastened, for example is interference embedded, on the stem 41 during the stages of manufacture.

The passages 67 comprise respective end portions 68, which exit directly into the annular chamber 43 and extend along respective axes 69 parallel to axis 5, with areas of passage that are constant along these axes 69. In this way, portions 68 cause the canalization or guiding of the respective fuel flows, which then exit into the annular chamber 43, and do not give any swirling motion to these fuel flows in the annular chamber 43.

Preferably, passages 67 also comprise respective initial portions 70, which define a larger area of passage than portions 68 and are connected to portions 68 by respective intermediate portions 71. The latter define a taper, with an area of passage that decreases, preferably in a progressive manner (without steps), up to the inlet of portions 68 to limit pressure losses at this inlet. Preferably, each pair of portions 70 and 71 is aligned with the respective portion 68 along axis 69.

Advantageously, the minimum area of passage of the passages 67 is defined by portions 68.

The presence of the initial portions 70, which are widened, advantageously limits the axial length of the portions 68. In fact, sectors 65 also have a guide function for the valve needle 12 with respect to the nozzle 11 and so, to all intents and purposes, they cannot have an axial length of less than 2 mm for performing this function; due to the relatively low areas of passage along portions 68, there would be significant losses from viscous fiction if portions 68 were as long as sectors 65.

Figure 9:
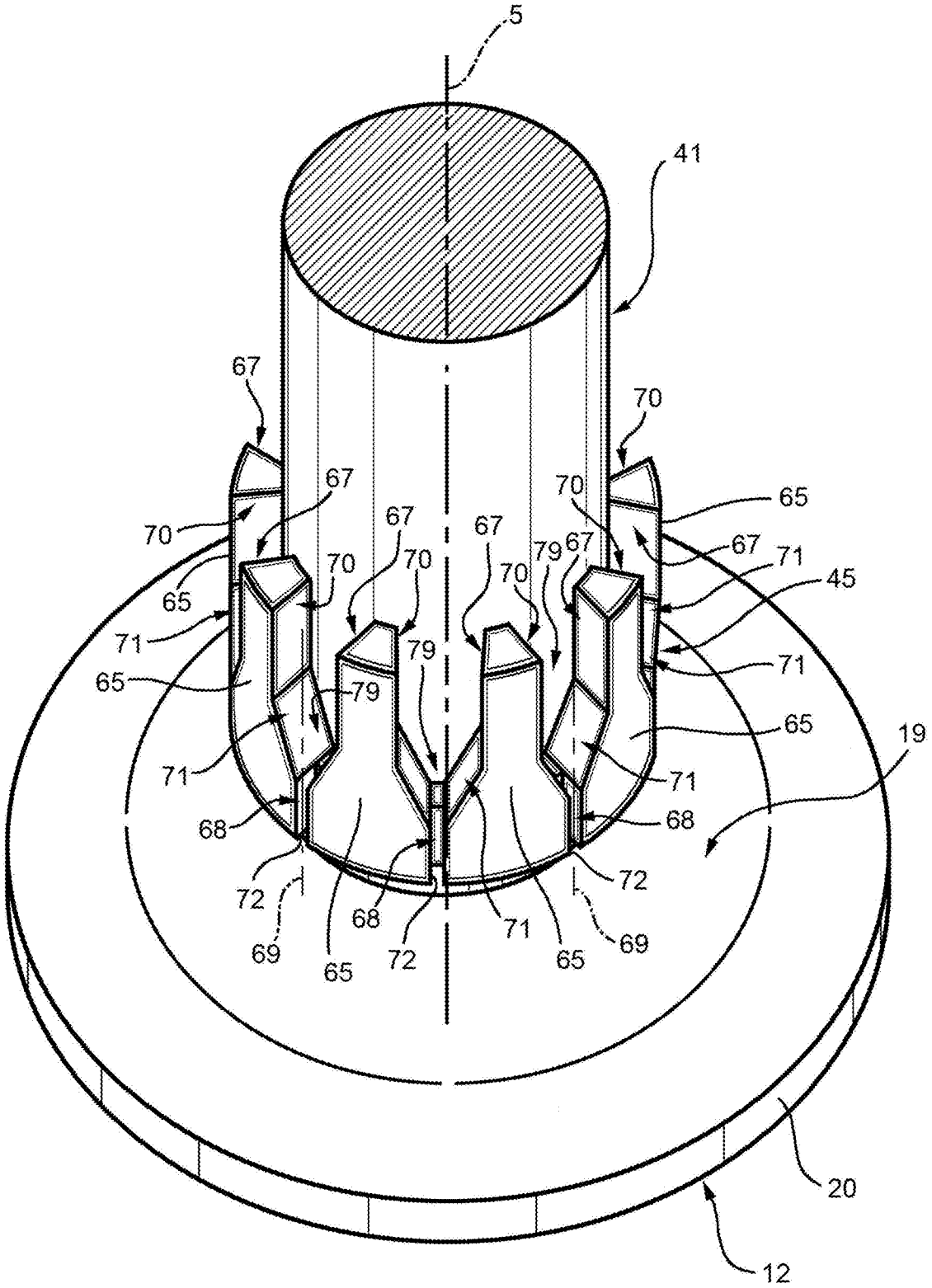
FIG. 9 is a perspective view showing a variant of the valve needle in the atomizer of the present invention.

According to the variant shown in FIG. 9, the intermediate portions 71 have a greater radial depth than that of portions 68 and so the bottom surfaces of portions 68 and 71 are joined to each other, at the inlet of the portions 68, by respective connection surfaces 79, transversal to axes 5 and 69. In the preferred example shown, surfaces 79 are orthogonal to axis 5. However, according to variants that are not shown, surfaces 79 could have a slight inclination to provide a taper function, similar to the converging sides of the intermediate portions 71.

By making the intermediate portions 71 radially deeper, it is possible to avoid problems of excessive choking of the areas of passage in the intermediate portions 71. In other words, due to the increased depth of the intermediate portions 71, a sufficient area of passage is ensured to minimize load loss in passing through the intermediate portions 71.

The overall minimum area of passage available for fuel in passages 67 is still relatively large. In fact, on one hand, the restriction in area of passage for entering the passages 67 introduces a pressure drop of not more than 35% in the inlet pressure at the inlet of the passages 67: in this way, the fuel leaving portions 68 in the annular chamber 43 has a pressure almost equal to 65% of this inlet pressure, with a velocity substantially proportional to the pressure drop (according to Bernoulli's principle, in a first approximation assuming the fuel to be incompressible and ignoring losses due to viscous friction).

On the other hand, the passages 67 do not have the function of determining the flow of fuel delivered. In fact, their function is rather that of converting part of the pressure in velocity of the fuel inside the annular chamber 43, without a substantial drop in total fuel pressure (the conservation of total pressure depends, as explained further on, on the viscous friction of the fluid).

For example, if the maximum lift of the valve needle 12 is 0.02 mm, the average diameter of the sealing seat 21 is 3 mm and the half-angle at the vertex of the conical surface 19 with respect to axis 5 is 55°, then the area of passage at the discharge section 14 is approximately 0.15 $mm^2$: by applying the conservation law of the flow in portions 68 and in the discharge section 14 and making use of Bernoulli's theorem applied between the inlet of passages 67 and the outlets in the annular chamber 43, and also Bernoulli's theorem applied between the inlet of passages 67 and the discharge section 14, setting the pressure at the outlet of portions 68 to be at least 65% of the inlet pressure, and also ignoring the losses due to viscous friction and/or thermal dissipation and considering the fluid to be incompressible, it is possible to write a three-equation system with three unknowns (fluid velocity through passages 67, fluid velocity through the discharge section 14 and the overall area of passage in portions 68). From this system, it is found that the overall minimum area of passage in passages 67 must be at least 0.28 $mm^2$.

In these conditions, if the total pressure, i.e. the pressure of the fuel in the common rail of the injection system, is for example equal to 1000 bar and the pressure in the combustion chamber 2 is for example 40 bar, the pressure at the outlet of portions 68 will be approximately 650 bar and the velocity through the discharge section 14 will be approximately 365 m/s, while the velocity at the outlets of the annular chamber 43 will be approximately 210 m/s.

It is evident that the area or section of passage available for fuel in passages 67 is less than that available in the annular passageway 16 upstream and downstream of the intermediate portion 45, and so passages 67 define a hydraulic resistance and cause a drop in total pressure between the end zone 42 and the annular chamber 43 when fuel flows. In turn, the discharge section 14 defines another hydraulic resistance, which is adjustable by varying the lift of the valve needle 12: hence, if it is wished to take these energy losses into account, it is necessary to increase the maximum permitted value for the pressure drop across portions 68 by approximately 10%, and so the maximum permitted value for the pressure drop across passages 67 is 45%, noting that the predominant part consists in the conversion of pressure into kinetic energy of the fuel.

Figure 3:
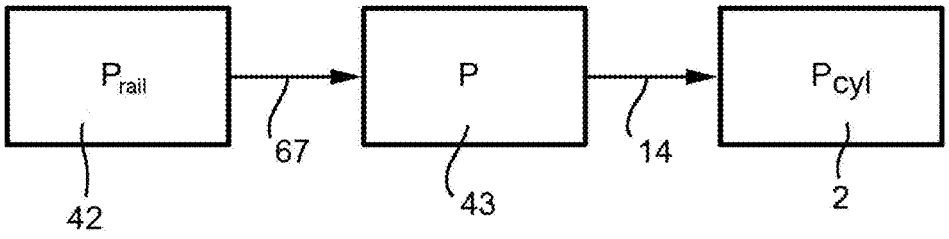
FIG. 3 is a hydraulic operation diagram of the atomizer in FIG. 2.

FIG. 3 shows a block diagram regarding this hydraulic configuration of the atomizer 10 during injection. As mentioned above, the pressure in the end zone 42 is substantially the supply pressure (prail) imposed by the injection system, while in the combustion chamber 2 it is the pressure (pcyl) of the air in the cylinder during injection. The average pressure (p) inside the annular chamber 43 takes an intermediate value between prail and pcyl during fuel delivery and, with the geometry of passages 67 and the atomizer 10 as a whole fixed, and with the operating conditions of the electro-injector 1 fixed (prail, pcyl and fuel flow rate), can be calculated via the above-mentioned system of equations or determined via opportune fluid dynamics simulations on a computer to evaluate the entity of the losses due to viscous friction and turbulence with greater precision.

Figure 4:
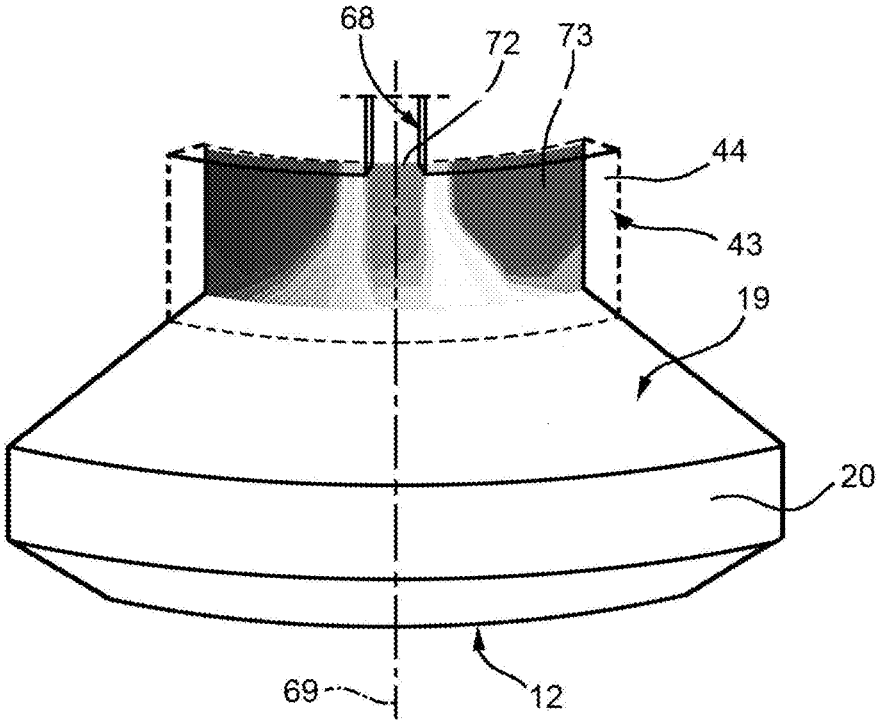
FIG. 4 schematically shows, in perspective and with parts removed for clarity, a velocity profile of the fuel inside the atomizer in FIG. 2.

The outlets of portions 68 of passages 67 are identified in FIGS. 2 and 4 by reference numerals 72: when the nozzle 11 is open, the fuel leaving the passages 67 locally has a higher velocity at the outlets 72 with respect to the fuel in the annular chamber 43 in points 73 that are intermediate between the outlets 72 along the same circumference (as can be inferred from the flow lines that are schematically indicated in FIG. 4 and derived from computer simulations).

Preferably, the annular chamber 43 has a sufficiently small size such that it cannot make the velocity of the fuel uniform before the streams of fluid exiting the passages 67 reach the discharge section 14, at least in a reference operating condition, for example that where the supply pressure (prail) takes the maximum value allowed by the injection system and the lift of the valve needle 12 also takes the maximum allowed value (i.e. in maximum load or power operating conditions).

Figure 6:
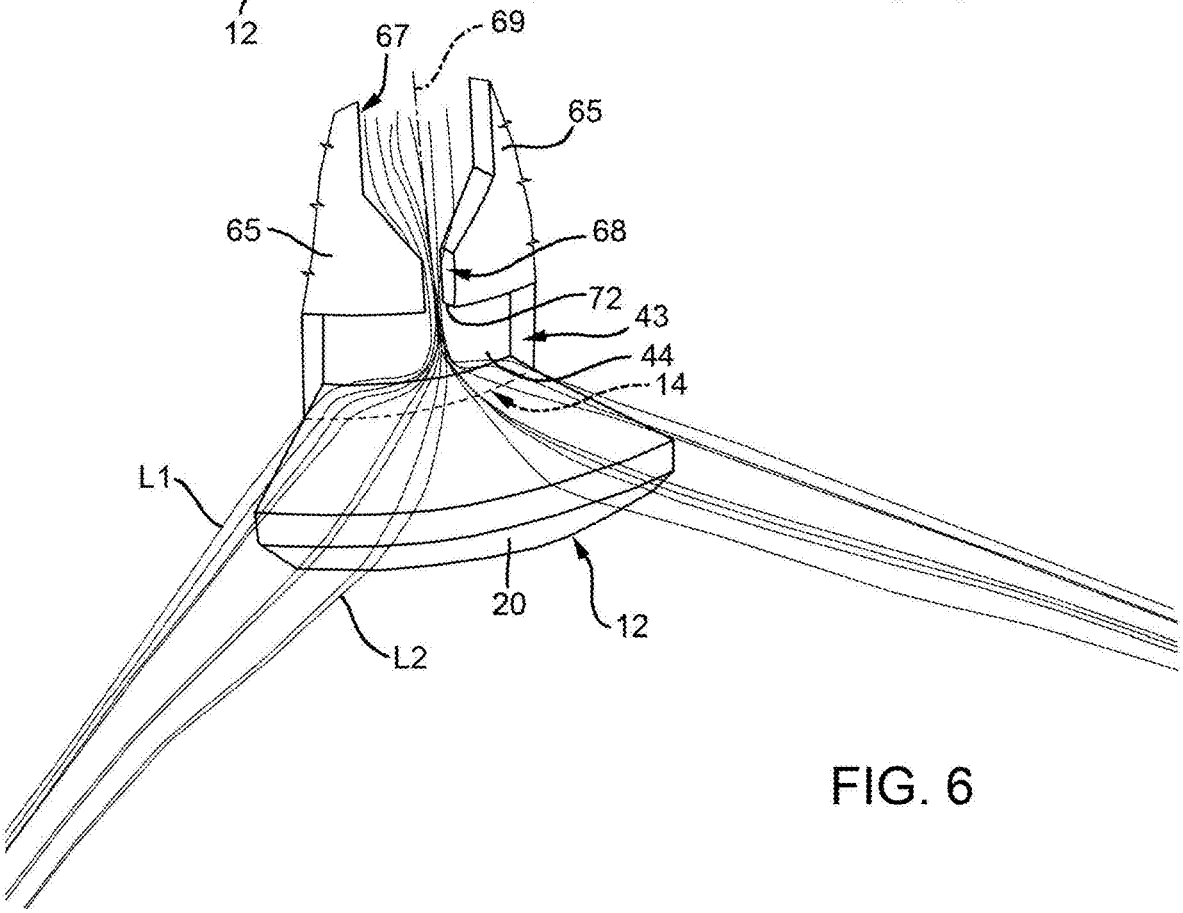
FIG. 6 is similar to FIG. 5 and shows a different diagram.

FIG. 5 is also derived from computer-performed fluid dynamics simulations, and schematically shows the velocity distribution on three cylindrical surfaces inside a segment of the spray leaving the nozzle 11 and concentric with axis 5: in particular, the innermost cylindrical surface lies in correspondence to the discharge section 14, while the other two lie in correspondence to two different circumferences downstream of the discharge section 14. FIG. 6 is similar to FIG. 5 and shows several flow lines that, qualitatively, show the trajectories of respective fluid streams through the annular chamber 43 and downstream of the discharge section 14 in the combustion chamber 2.

At the discharge section 14, it can be noted how the velocity of the spray's fuel film is not uniform along the circumference, but has peaks in the modulus of velocity in a number of zones equal the number of passages 67 and which are substantially aligned with the outlets 72 along the respective axes 69. In other words, the fuel film exiting at the discharge section 14 is composed of spray portions 75 that correspond to these zones of higher velocity, and spray portions 76 that correspond to zones of lower velocity and which are in intermediate angular positions between passages 67. The difference in the modulus of velocity between the maximum value and minimum value must be appreciable, i.e. at least 10% with respect to the maximum value.

Thus, the fuel film that leaves the discharge section 14 is not homogeneous in terms of modulus of velocity, but has faster portions, those corresponding to the radial planes on which the axes 69 of passages 67 lie, and slower zones, in the intermediate angular positions between passages 67. Observing the flow lines L1 and L2 in FIG. 6, both leave the outlet 72 of portion 68 with the same velocity. In the first part of their path, i.e. that inside the annular chamber 43, fuel particles along flow lines L1 travel a longer distance to reach the discharge section 14 with respect to fuel particles along flow lines L2, which instead have a more direct path: this entails a slowing down along flow lines L1 with respect to L2.

Immediately after the discharge section 14, the exiting fuel film is still intact and, given the above, is not homogeneous in terms of velocity of the fluid streams: but as the fuel moves away from the discharge section 14, it encounters the air present in the combustion chamber 2 that, as is known, exerts a slowing down force on the fuel film. This force is proportional to the square of the relative velocity between air and fluid fuel. Therefore, fluid streams along flow lines L2 are subjected to a greater slowing down force with respect to fluid streams along flow lines L1.

The result is that the fluid streams along flow lines L2, being more obstructed by the air, tend to diverge from the initial radial direction and accumulate laterally, i.e. towards the radial planes that are intermediate between the axes 69 of passages 67, and so, in practice, they accumulate towards the fluid streams that follow flow lines L1. This phenomenon also entails a delay in the formation of the first drops, which, thanks to the build-up of the fluid streams, will have a larger diameter with respect to the thickness of the fluid film leaving the discharge section 14. Furthermore, the fluid streams along flow lines L1, by being surrounded by the fluid streams along flow lines L2, benefit from favorable reciprocal sliding phenomena, which allow greater penetration in the combustion chamber.

Figure 8:
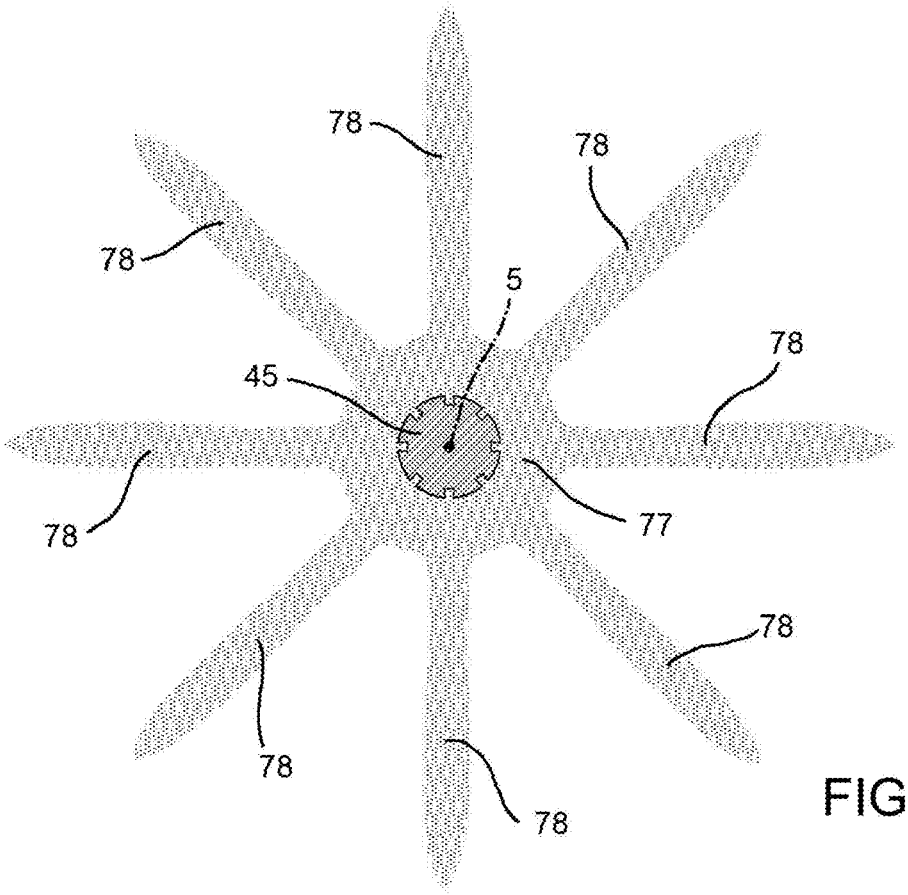
FIG. 8 shows a fuel spray pattern delivered by the atomizer of the present invention.

At the moment of opening the nozzle 11 and immediately afterwards, the spray is substantially uniform along the circumference; in the moments following, as shown in FIG. 8, the fuel spray pattern acquires a shape constituted by an umbrella-shaped central part 77 and a plurality of cusps or tentacles 78, that are equal in number to the number of passages 67 and protrude from the outside edge of the central part 77. It is therefore evident that the fluid streams that form spray portions 75 contribute with the fluid streams of spray portions to form the cusps 78, with a higher penetration in the combustion chamber 2.

As the injection pressures and/or lift of the valve needle 12 increase, there is an intensification in penetration, i.e. the cusps 78 become more defined and marked: the spray becomes very similar to that produced by an atomizer with a solid-cone spray. In other words, the diameter of the central part 77 can also be modulated by variation in lift and/or supply pressure, once the geometry of the atomizer 10 is defined.

Different areas of passage of passages 67 also cause a change in the penetration of the cusps 78 and/or a change in the diameter of the central part 77.

According to the present invention, as will be described in detail hereinafter, penetration of the cusps 78 is increased and the diameter of the central part 77 is reduced by opportune choices in the shape/size of the cross-section of portions 68 and, where necessary, by an opportune choice of the number of passages 67.

With regard to the formation of the fuel spray, as mentioned above and as visible in FIG. 5, starting from the discharge section 14, each of the spray portions 75 tends to split into two sub-portions 75*a* and 75*b*, basically due to the effect of the opposing resistance of the air in the combustion chamber 2. The sub-portions 75*a* and 75*b* generated by a given channel 67 progressively move apart from each other in a circumferential direction, inside portions 76, as the distance of the fuel from the discharge section 14 increases. In other words, it is as if the flow lines followed by the fuel at higher velocity become sucked in a circumferential direction towards the zones where the fuel has a lower velocity.

As this lateral divergence of the faster fuel path proceeds, with respect to the original direction imposed by passages 67 along axes 69, sub-portions 75*a* and 75*b* combine, in a manner not shown, with sub-portions 75*b* and 75*a* that were generated by adjacent passages 67. From this phenomenon, it follows that the cusps 78 visible in FIG. 8 are not radially aligned with the axes 69 of passages 67, but are arranged, with respect to axis 5, in angular positions that are intermediate between passages 67, as already explained above in detail.

As mentioned above, to obtain this configuration of the fuel spray with the cusps 78, it is essential that the annular chamber 43 is of sufficiently small size, also in relation to the type of fuel used, to the supply pressure value (grail) and to the lift value of the valve needle 12 when the nozzle 11 is open. In particular, the further away the discharge section 14 is from the outlets 72, the more uniform the modulus of velocity of the fuel along the circumference at discharge section 14, as the velocity of the fuel leaving passages 67 has time and space to become more uniform in the annular chamber 43, and so there is the risk that no cusp 78 is formed.

Therefore, the annular chamber 43 has a size and/or shape such as to inject fuel with a non-uniform modulus of velocity at the discharge section 14, as the position changes in a circumferential direction, at least in one reference operating condition of said engine.

In the particular example of diesel fuel, to obtain the cusps 78 in the reference operating condition, for example that of maximum power or load (supply pressure prail and lift of the valve needle 12 at the maximum values allowed by the technologies normally used), it is preferable that the distance along axes 69 between the outlets 72 and the discharge section 14 is not more than ⅓ of the average diameter of the sealing zone 21. For example, if this diameter is approximately 3 mm, the distance between the outlets 72 and the discharge section 14 is preferably less than or equal to 1 mm.

As mentioned above, the shape and/or volume of the annular chamber 43 can also affect the velocity profile of the fuel in the discharge section 14 to some extent: in particular, an increasingly evident non-uniform velocity profile is obtained as the volume of the annular chamber 43 decreases. For example, in the case of diesel fuel, to obtain sufficiently pronounced cusps 78 in high-load operating conditions, the maximum volume can be taken as equal to the volume of a hollow cylinder with an outer diameter equal to the average diameter of the sealing seat 21, a height equal to ⅓ of this average diameter, and an inner diameter equal to 80% of the outer diameter. With an increase in volume of the intermediate chamber 43, tendentially there is the effect of making the flow lines leaving the portions 68 uniform, with the consequence of having greater uniformity of velocity at the discharge section 14 and therefore a less pronounced effect in forming cusps 78.

A further factor that can affect the uniform or non-uniform velocity profile of the fuel along the discharge section 14 is given by the minimum area of passage of each channel 67, as mentioned above. In fact, as this minimum area of passage decreases, it is possible to achieve a higher fuel velocity at the outlet 72 and, consequently, more marked canalization and differentiation of the flow lines (L1 and L2) in the annular chamber 43, in the passage of fuel going from the outlet 72 to the discharge section 14. Preferably, in the case of diesel fuel, for an injection system that operates with a maximum pressure of 2000 bar and must deliver a maximum flow of approximately 70 g/s, to obtain sufficiently marked cusps 78, for example in an operating condition of maximum power or maximum load, the area of passage of a single channel 67 to the outlet 72 is less than 0.05 $mm^2$.

In the design phase, once the engine and the injection system are known, the air supercharging pressure (pcyl) and the fuel supply pressure (prail) are known and/or controllable. In particular, the atomizer 10 can be obtained through the following design steps:

- the amount of fuel to inject in the combustion chamber 2 in a reference operating condition (for example, at full power or full load) on each single injection is determined, possibly on the basis of engine size and application;
- the maximum value pmax that the supply pressure (prail) of the fuel fed to the electro-injectors can have, for example 1800 bar, is determined;
- a tentative value is determined for the opening angle of the cone of surface 19 of the valve needle 12, for example 140°, also on the basis of the shape of the combustion chamber 2: this opening angle of the cone of surface 19 will define the emission angle of the fuel spray;
- the maximum possible value for the lift of the valve needle 12 is determined (for example 20 micron), in particular on the basis of the actuator device 50 that has been chosen;
- preferably, the minimum actuation time that can be managed with satisfactory precision is determined (for example 50 ms), on the basis of the accuracy of the control unit and the actuator device 50 chosen;
- preferably, the minimum permissible value is determined for the injection time in combustion chamber 2, i.e. permissible to ensure optimal combustion in the reference condition (for example 600 microseconds): in this way, having defined the maximum volume to inject, the minimum permissible instantaneous flow rate for the electro-injector 1 is also defined;
- a tentative value is determined for the average diameter of the seal segment 21 (for example 2.5 mm) in order to respect the minimum injection time and guarantee the maximum flow rate of fuel to inject, and preferably in such a way that this average seal diameter is as small as possible whilst being compatible with the necessary structural resistance to be for the valve needle 12;
- the maximum area of passage at the discharge section 14 (Aconemax) is calculated from the maximum lift, the average diameter of the seal segment and the opening angle of the cone of surface 19;

a fixed value (tau) defining the ratio between the overall area of passage available in portions 68 of the passages 67 and the maximum area of passage at the discharge section 14 is set; in particular, this value is assumed to be between 1.1 and 1.4; the larger this value, the smaller will be the pressure drop through the passages 67, and the slower the output velocity from portions 68;

the overall area of passage available in portions 68 of the passages 67 is calculated (tau*Aconemax);

a tentative value is set for the number of cusps 78, comprised between 8 and 15, that it is preferably wished to obtain (also as a function of the other parameter of the combustion chamber 2, such as the swirl rate, size, etc.); this number will correspond to the number of passages 67 to provide in the design and to manufacture;

the area of passage available in each single portion 68 is calculated from the number of passages 67 (set as a tentative value), (assuming that all portions 68 have the same cross-section);

it is checked that with this sizing, the atomizer 10 is capable of delivering the maximum flow of fuel necessary for obtaining the operating requirements of the engine when the fuel supply pressure in the common rail is equal to the maximum value pmax (in particular, assuming discharge coefficients of approximately 0.8-0.85 for passing through passages 67 and the discharge section 14 and using the Bernoulli equations); if the check fails, successive attempts are made:

by increasing the number of passages 67 that was initially assumed and repeating the subsequent steps, and/or by increasing the value set for the seal diameter and repeating the subsequent steps, and/or by increasing the value set for the opening angle of the cone of surface 19 and repeating the subsequent steps.

When the check on the maximum flow rate condition is successful, the shape and/or effective sizing of the cross-section of portions 68 of the passages 67 can then be defined.

Figure 7:
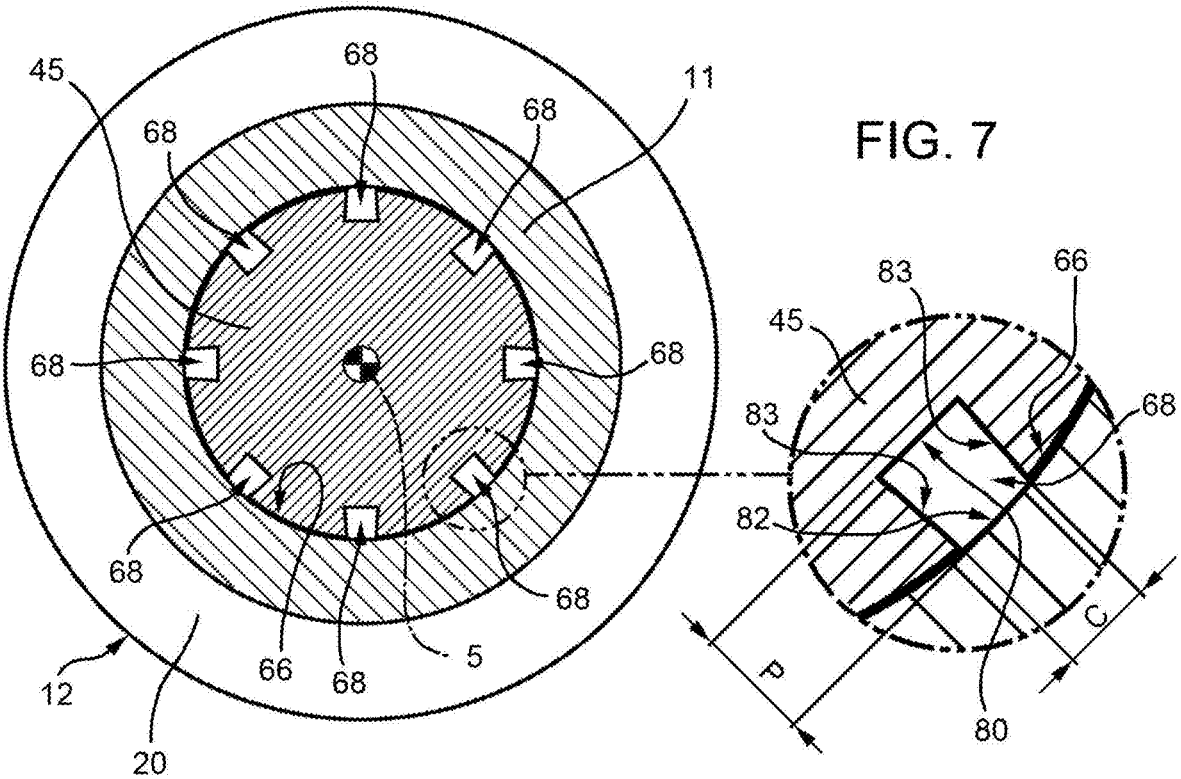
FIG. 7 is a section along the section plane VII-VII in FIG. 2.

As shown in FIG. 7, each portion 68 is considered to be radially delimited by an inner surface or bottom surface 80 (radially closer to axis 5 and forming part of the stem 41) and by an outer surface 82 (radially further away from axis 5 and forming part of surface 66). At the same time, each portion 68 is delimited in a circumferential direction by two sides 83 facing each other. According to the present invention, a value greater than or equal to two is chosen for the ratio between the depth P in the radial direction and the outer chord C of the cross-section of each portion 68. In particular, "depth" means the radial distance between surfaces 80 and 82, and "outer chord" means the distance in a tangential direction between the ends of sides 83 on surface 82.

Instead of a wide and radially shallow shape, this narrow and deep shape at the outlets 72 enables significantly limiting the diameter of the central portion 77 and increasing the penetration of the cusps 78, as it performs a more significant guide function for the streams leaving the passages 67.

In combination with this shape of the cross-section, the number of passages 67 also affects reduction in the diameter of the central portion 77 and/or increasing the penetration of the cusps 78. In fact, as indicate above, this number is advantageously chosen between 8 and 15. Values close to 15 can be set in supply systems in which the maximum supply pressure (pmax) in the common rail is higher, in which the maximum flow rate required from the atomizer 10 is greater, or in which the seal diameter of the valve needle 12 is larger. The size of the combustion chamber must also be taken into consideration when choosing the number of passages 67.

According to a preferred aspect of the present invention, the shape of the cross-section of each portion 68 is also optimized.

In particular, with reference to the enlargement shown in FIG. 7, to obtain high penetration of the cusps 78 and/or reduce the diameter of the central part 77, it is preferable to choose a shape in which the sides 83 are parallel to each other, with respect to a shape in which the sides 83 converge from the surface 82 towards surface 80; it would be even more advantageous to choose a shape in which the sides 83 converge from surface 80 towards surface 82 (even if this solution might pose practical manufacturing problems).

In addition, as mentioned above, one or more design steps are advantageously contemplated for determining appropriate sizing of the annular chamber 43 in order to achieve the desired result for formation of the cusps 78 in the fuel spray, at least in a reference operating condition, for example that of full load. In particular, these design steps contemplate appropriate positioning of the outlets 72 of passages 67 with respect to the sealing seat 21. To simplify this design step, as indicated above, the outlets 72 are positioned so as to be axially distanced from the sealing zone 21 by less than one third of the previously-set average seal diameter value. Advantageously, this distance will be less than 0.8 mm. Preferably, the innermost diameter of the annular chamber 43 (i.e. the minimum diameter of the end 44) is greater than 80% of the outer diameter, and so will be greater than 2 mm in the example considered.

A simulation test using CFD (Computational Fluid Dynamics) analysis or experimental tests on prototypes in a suitable quiescent chamber are needed to check the fuel spray pattern. From that described above, it emerges that the optimization of the cross-section of portions 68 of the passages 67 enables obtaining a fuel spray pattern of the atomizer 10 verging considerably on that which in the known art is provided by multi-hole atomizers with a solid-cone spray.

In fact, as explained above, by making portions 68 with a cross-section that is narrow in the tangential direction and long in the radial direction, it is possible to increase penetration of the cusps 78 and/or reduce the diameter of the central portion of the spray. In particular, the greater radial depth of portions 68 causes a greater guide and canalization effect on the flow lines of the fuel leaving the outlets 72.

As a consequence, this particular spray shape enables obtaining a traditional mode of the CI (Compressed ignition) type, especially at high loads, i.e. high fuel penetration in the combustion chamber 2, in a similar manner to what happens with atomizers of the known art with a solid-cone spray.

It is also possible to optimize the shape (rectangular or trapezoidal) of the cross-section of portions 68 and/or the choice of the number of passages 67 for the same purpose.

At the same time, if necessary, it is possible to have a HCCI (Homogeneous-Charge Compression-Ignition) type of operating mode at low and medium loads, with high fuel atomization and without cusps 78: purely by way of example, to prevent cusps 78 from appearing in the injected fuel spray, the supply pressure (prail) can be reduced so as to lower fuel velocity at the outlets 72 and/or a relatively low lift can be set for the valve needle 12 to have greater back pressure in the annular chamber 43. With these operating modes (which obviously correspond to lower fuel flows than that at full load), even with its small size, the annular chamber 43 can make the velocity of the fuel uniform to obtain a substantially uniform modulus of velocity in the circular direction along the discharge section 14 in the low and medium load operating conditions of the engine.

As mentioned above, it is also possible to size the volume of the areas of passage of portions 68 and/or the size and/or shape of the annular chamber 43, so as have a spray pattern characterized by highly accentuated cusps 78, and therefore an extremely small central portion 77, even at low engine loads: this need can arise, for example, for particularly large combustion chambers 2, where it is wished to avoid any fuel build-on the axis 5 of the electro-injector 1.

With regard to the atomization of the fuel drops in the spray delivered by the nozzle 11, the lateral drift of the flow lines L2 downstream of the discharge section 14 also causes a partial build-up or coalescence of fuel drops at higher velocities. These drops thus tend to increase in volume in the first part of their path. Thanks to this partial coalescence, the drops that will form the cusps 78 are larger and therefore characterized by greater kinetic energy and a higher Weber number with respect to those in a spray with a substantially constant modulus of velocity along the circumference. It follows that the fuel drops that will form the cusps 78 are more easily subject to fragmentation into smaller drops in the second part of their path, i.e. precisely in the cusps 78. In other words, the behavior of the fuel drops that form the cusps 78 verges decidedly close to what happens with fuel drops delivered by atomizers of the known art with a solid-cone spray.

Furthermore, the increased depth of the intermediate portions 71 enables reducing energy losses of the flow while passing through the passages 67.

Furthermore, the geometry of the annular chamber 43 could be sized so as to have a shape in the circumferential direction that is not homogeneous or constant, i.e. a variable cross-section so as favor canalization and therefore the non-uniformity of the flow lines in the annular chamber 43.

In particular, by opportunely optimizing the geometry of the annular chamber 43, it is possible, where necessary, to reduce the pressure drop and therefore the fluid velocity conversion in passages 67, with the advantage of having smaller energy losses.

Various modifications can however be made to the atomizer 10 that has been described with reference to the accompanying drawings, while the generic principles described can be applied to other embodiments and applications without departing from the scope of present invention, as defined in the appended claims. Therefore, the present invention should not be considered as limited to the embodiments described and illustrated herein, but is to be accorded the widest scope consistent with the principles and characteristics claimed herein.

In particular, the nozzle 11 could be defined by an end portion of the injector body 4, without being a separate piece from the latter, and/or the guide portion 46 could form part of a body separate from the nozzle 11, and/or the valve needle 12 could be operated directly, i.e. the injector 1 might lack the pressure chamber 62.

As mentioned above, the shape of the annular chamber 43 could be different from that shown in section in the drawings enclosed by way of example, possibly through shaping the inner surface of seat 13 of the nozzle 11 (alternatively or in combination with shaping of the stem 41 of the valve needle 12).

There could be a different number of passages 67 from that shown, and/or they could be constituted by just portions 68, i.e. have an area of passage that is constant along axes 69 and so lack portions 70 and 71. In addition, sectors 65 could constitute part of the nozzle 11 so as to define a step-shaped and not cylindrical surface 66, and be coupled to the stem 41 in a sliding manner.

As an alternative to a piezoelectric or magnetostrictive actuator, a solenoid actuator could be used that, even though basically operating only in two or three discrete positions, could be capable of generating the desired spray, for example by regulating the injection pressure and/or the actuation time of the electromagnet.

Moreover, the atomizer 10 could be applied to fuels other than diesel fuel, and so it might be necessary to set different dimensions for the annular chamber 43 and/or the passages 67 to obtain a non-uniform velocity profile for the fuel along the discharge section 14 and therefore the same effect resulting from the cusps 78 shown in the accompanying drawings.

Finally, the passages 67 could be arranged in non-uniform positions around axis 5, for example closer to each other in the zone of the combustion chamber 2 where greater spray penetration is required. Especially in this case, it is also possible to obtain asymmetry in the width or penetration of the cusps 78 in the same spray.

We claim:

1. A fuel electro-injector atomizer for an engine comprising a nozzle having:

a feedthrough seat that extends along a longitudinal axis;

a front surface that is external to said feedthrough seat;

a sealing seat that joins a first surface of said feedthrough seat to said front surface;

said atomizer further comprising a valve needle comprising:

a head suitable for coupling with said sealing seat;

a stem, which has a smaller diameter than said head, axially projects from said head and engages said feedthrough seat; said stem and said nozzle radially defining an annular passageway between them, through which a flow of high-pressure fuel can run, and comprising an annular chamber, which axially terminates at said sealing seat; said stem comprising an intermediate portion coupled in an axially sliding manner to a second surface of said feedthrough seat;

said intermediate portion and said second surface delimiting a plurality of channels, each channel of the plurality of channels having a respective outlet in said annular chamber;

each channel of the plurality of channels comprising a respective channeling portion, which defines a minimum area of passage of said channel and has a cross-section with a depth (P) in a radial direction and an outer chord (C) in a tangential direction along said second surface;

said valve needle being axially movable along an opening stroke directed axially outwards from said feedthrough seat, starting from a closed position wherein said head is coupled to said sealing seat;

said sealing seat and said head defining a discharge section, which is annular and has a width that increases as the opening stroke of said valve needle proceeds;

characterized in that, for at least one of said plurality of channels, the ratio between said depth (P) and said outer chord (C) is greater than or equal to two; and each channel of the plurality of channels is defined by an outer wall of the stem and sidewalls extending radially outward from the stem and comprises a taper portion disposed upstream of the channeling portion of the channel, considering the direction of fuel towards said sealing seat, and progressively diminishes towards said channeling portion and wherein the channeling portion canalizes fuel flow.

2. An atomizer according to claim 1, characterized in that, for all said channels, the ratio between said depth (P) and said outer chord (C) is greater than or equal to two.

3. An atomizer according to claim 1, characterized in that the number of said channels is between 8 and 15.

4. An atomizer according to claim 1, characterized in that said cross-section is defined:

radially by an inner surface, forming part of said stem, and by an outer surface, forming part of said second surface, and in a circumferential direction by two sides facing each other;

said sides being:

parallel to each other, or convergent from said inner surface towards said outer surface.

5. An atomizer according to claim 1, characterized in that said annular chamber is designed with dimensions and/or shape such as to inject fuel with a non-uniform modulus of velocity at said discharge section, as the position in the circumferential direction changes, in at least one reference operating condition of said engine.

6. An atomizer according to claim 5, characterized in that the axial distance between said outlets and said sealing seat is less than or equal to a third of an average diameter of said sealing seat.

7. An atomizer according to claim 5, characterized in that the volume of said annular chamber is less than or equal to a maximum volume equal to a volume of a cylinder having: an outer diameter equal to the average diameter of said sealing seat; a height equal to a third of said average diameter; and an inner diameter equal to 80% of said average diameter.

8. An atomizer according to claim 1, characterized in that each channeling portion extends along a respective canalization axis parallel to said longitudinal axis and has an area of passage that is constant along the respective canalization axis.

9. An atomizer according to claim 1, characterized in that said channeling portions terminate at said outlets.

10. An atomizer according to claim 9, characterized in that said channeling portions extend axially along the entire axial length of said intermediate portion.

11. An atomizer according to claim 1, characterized in that the opening stroke of said valve needle has a maximum lift; and that said channeling portions, as a whole, define a minimum area of passage that is greater than the width of said discharge section even when the opening stroke reaches said maximum lift.

* * * * *